US006311942B1

(12) United States Patent
Rotter et al.

(10) Patent No.: US 6,311,942 B1
(45) Date of Patent: Nov. 6, 2001

(54) BEDSIDE CANE HOLDER

(75) Inventors: Leah Rotter, Los Angeles; Willis C. Bradley, Gardena, both of CA (US)

(73) Assignee: Lenjoy Engineering, Inc., Gardena, CA (US)

( * ) Notice: Subject to any disclaimer, the term of this patent is extended or adjusted under 35 U.S.C. 154(b) by 0 days.

(21) Appl. No.: 09/265,218

(22) Filed: Mar. 4, 1999

(51) Int. Cl.[7] ..... A47G 1/10; A47C 31/00; A45B 7/00

(52) U.S. Cl. ..... 248/316.5; 5/662; 135/65

(58) Field of Search ..... 248/316.1, 316.5, 248/316.6, 155.1, 155.2, 155.3, 155.4, 155.5, 205.1, 230.1, 230.4, 689, 155; 135/65, 66, 67, 73, 74, 76; 5/662, 426, 2.1, 3, 4

(56) References Cited

U.S. PATENT DOCUMENTS

| | | | | |
|---|---|---|---|---|
| 2,555,228 | * | 5/1951 | Evers | 5/426 |
| 2,811,978 | * | 11/1957 | Russell | 135/65 |
| 3,286,963 | * | 11/1966 | Bergman | 248/74.2 |
| 3,289,685 | * | 12/1966 | McCall Parker et al. | 135/65 |
| 3,387,618 | * | 6/1968 | Swann | 135/67 |
| 3,553,746 | * | 1/1971 | Seiger | 5/503.1 |
| 3,757,807 | * | 9/1973 | Manzo | 135/71 |
| 3,999,565 | * | 12/1976 | Delacour et al. | 135/65 |
| 4,300,742 | * | 11/1981 | Hunn | 248/689 |
| 4,932,090 | * | 6/1990 | Johansson | 5/662 |
| 5,295,498 | * | 3/1994 | Van Meter et al. | 135/65 |
| 5,400,450 | * | 3/1995 | Leoutsakos | 5/662 |
| 5,471,689 | * | 12/1995 | Shaw et al. | 5/662 |
| 5,482,070 | * | 1/1996 | Kelly | 135/66 |
| 5,771,910 | * | 6/1998 | Kluttz | 135/68 |
| 5,787,530 | * | 8/1998 | Brix | 5/662 |
| 5,806,548 | * | 9/1998 | Goldstein et al. | 135/65 |
| 5,924,434 | * | 7/1999 | Cato, III | 135/68 |

* cited by examiner

*Primary Examiner*—Anita King
(74) *Attorney, Agent, or Firm*—Natan Epstein Beehler & Pavitt

(57) ABSTRACT

A cane holder for holding upright a walking cane at the side of a bed has a generally planar frame to be inserted between a mattress and a box spring of a bed. A clamp on a side of the frame protrudes to one side of the bed. A walking cane held in the clamp provides a convenient hold for a person rising from the bed. The cane can then be released from the clamp for use as a walking aid away from the bed. A preferred walking cane has a foldable mid-height hand grip in addition to a top handle to provide two holds at different heights on the cane.

12 Claims, 2 Drawing Sheets

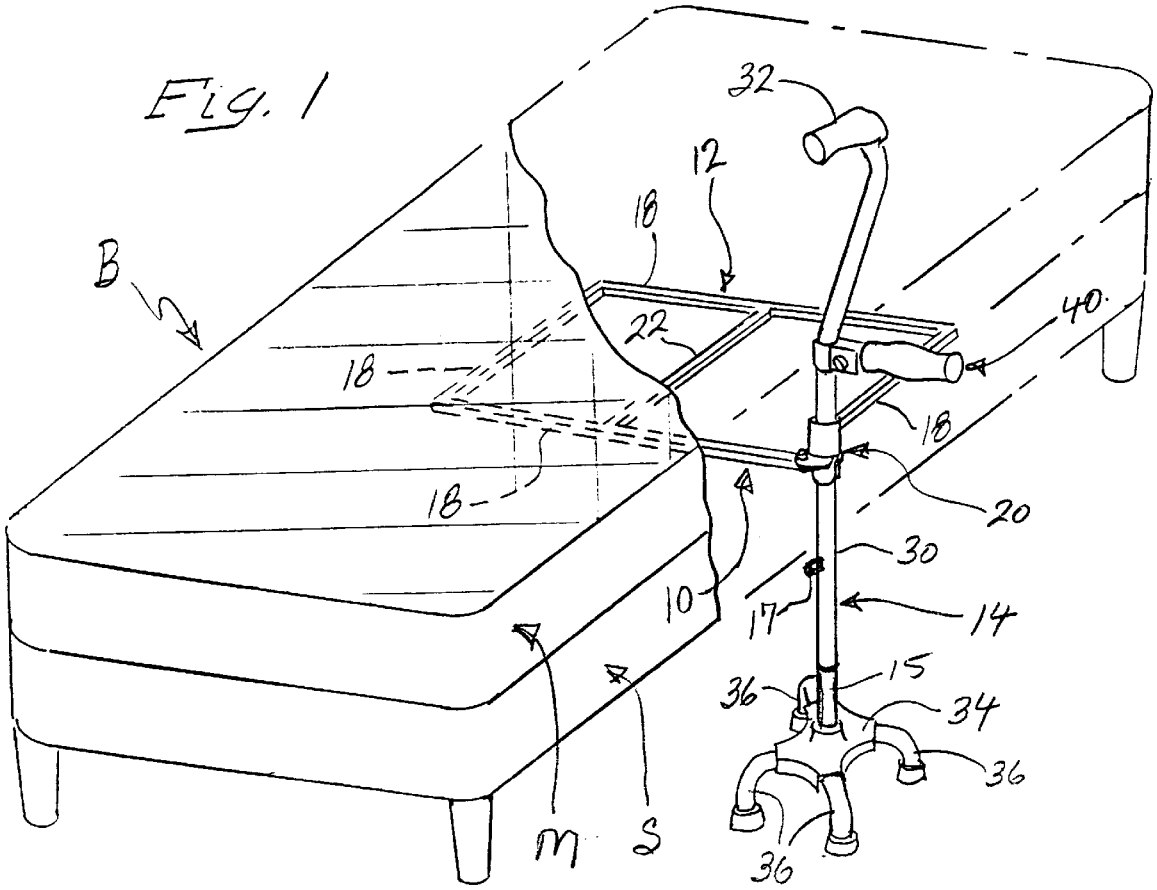
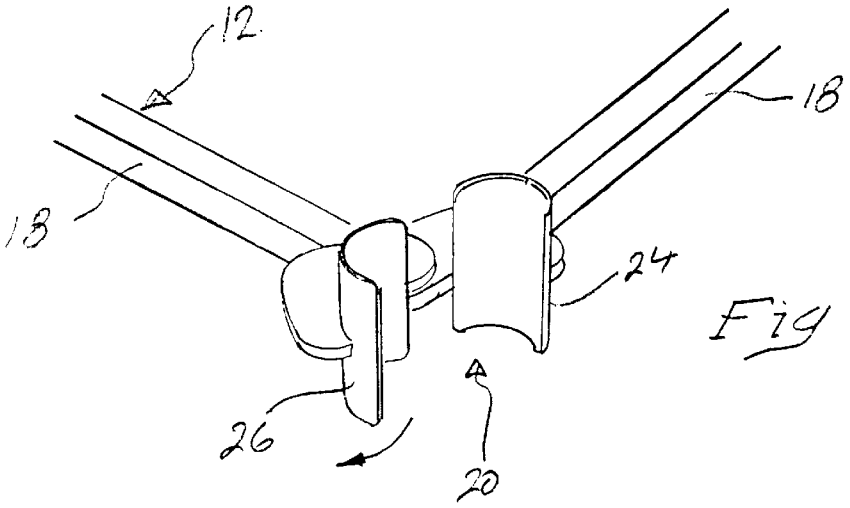
Fig 2

BEDSIDE CANE HOLDER

BACKGROUND OF THE INVENTION

1. Field of the Invention

This invention relates generally to the field of walking aids and supports for the infirm and more particularly concerns a holder for securing a walking cane at the side of a bed for use as a support by an infirm person while rising from the bed, the cane being releasable from the holder for use as a walking aid.

2. State of the Prior Art

The infirm often require a handhold of some type by which they can pull themselves up and out of a bed, and hospital beds typically have side rails for this purpose. However, most beds found in the home do not have any such handholds, and frail individuals frequently have difficulty rising from such beds. It is not uncommon for elderly persons to fall while rising from bed, leading to bone fractures and other injuries which in such persons are difficult to treat and may be life threatening. While seriously incapacitated patients may be best served by full fledged hospital beds, many otherwise self-reliant individuals need some help in getting out of bed but may not wish to give up their conventional box-spring/mattress beds. Improvised bedside support can be obtained by placing four legged supports, such as so-called walkers, next to a bed. The continuing trend towards home care of the ill and elderly calls for a bedside support solution compatible with existing home furnishings, particularly for persons who are ambulatory with the aid of a walking cane.

SUMMARY OF THE INVENTION

This invention addresses the aforementioned need by providing a cane holder for supporting a walking cane at the side of a bed. Although the cane holder may be used with different walking canes, a preferred walking cane is also disclosed.

In general, the cane holder includes a first member shaped and sized for insertion between a mattress and a box spring of a bed and a clamp assembly on the first member configured for releasably holding a cane in predetermined upright position relative to the first member. The cane holder is for use in combination with a walking cane, the cane preferably having a locking element movable thereon to and from locking engagement with the clamp assembly for securing the cane in the predetermined relationship in the clamp assembly.

A presently preferred walking cane for use with the holder frame has a cane shaft, a top hand grip on the shaft, a cane foot at a lower end of the shaft, and a mid-height hand grip intermediate the top hand grip and the cane foot, the mid-height grip being pivoted to the cane shaft for movement between a deployed position transverse to the shaft and a retracted position parallel to the shaft.

More specifically, the invention is directed to a cane holder for holding upright a walking cane at the side of a bed, the cane holder having a generally planar frame sized and configured to be inserted between a mattress and a box spring of a bed and to resist displacement from a generally horizontal plane defined between the mattress and the box spring, and a clamp assembly secured to the frame so as to protrude to one side of the mattress and box spring, the clamp assembly having first and second clamp elements hinged for movement between an open position for admitting the cane between the clamp elements and a closed position for holding the cane in transverse relationship to the frame.

A locking element on the cane is displaceable for securing the clamp elements in closed position with the cane held therebetween. The weight of a person on the mattress holds the frame in place thereby supporting the cane for use as a support by a person rising from the bed. The cane can then be released from the clamp assembly, by displacing the locking element, for use as a walking aid away from the bed.

The first and second clamp elements may each be a half-cylinder and the locking element may be a sleeve slideable along the cane to and from a locking position, the clamp elements being contained in the locking sleeve and about the cane in the locking position.

The frame is planar in shape for convenient insertion between the mattress and the box-spring and sized and shaped to ensure retention of the frame against significant lateral displacement between the mattress and the box spring under the body weight of the user. In particular, the frame has side dimensions much greater than the longitudinal dimension of the clamp elements. The presently preferred holder frame is rectangular and said clamp assembly is mounted on a corner of said holder frame.

The presently preferred walking cane for use with the cane holder is a quad style cane having a top hand grip and an mid-height hand grip, the mid-height grip being pivoted to a shaft of the cane for movement between an extended position transverse to the shaft and a retracted position parallel to the shaft, such that the mid-height grip in extended position supplements the top hand grip as a support for a person rising from the bed while the cane is held in the clamp assembly.

These and other improvements, features and advantages of the present invention will be better understood from the following detailed description of the preferred embodiments taken in conjunction with the accompanying drawings.

BRIEF DESCRIPTION OF THE DRAWINGS

FIG. 1 is a perspective view of the novel bedside cane holder installed in a typical box-spring/mattress bed;

FIG. 2 is a detail view of the clamp assembly of the clamp assembly of the bedside cane holder, shown in open position;

DETAILED DESCRIPTION OF THE INVENTION

Figure 3:
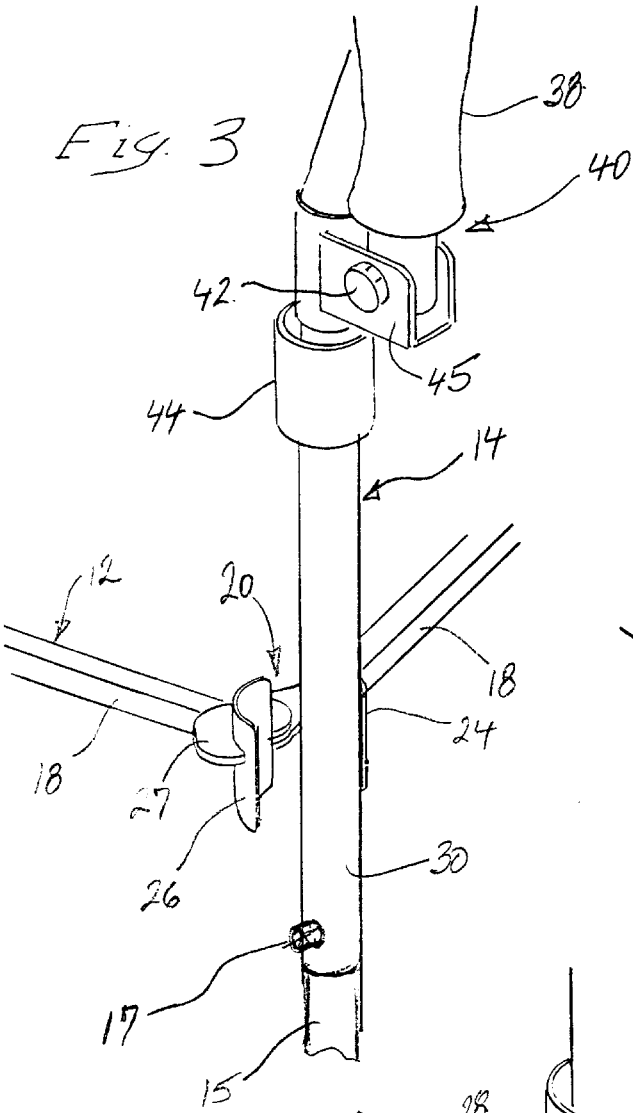
FIG. 3 shows a walking cane being placed between the open clamp elements of the holder and the locking sleeve raised above the clamp assembly.

With reference to the accompanying drawings wherein like elements are designated by like numerals, FIG. 1 shows a bedside cane holder, generally designated by numeral 10, installed on a typical bed B having a bed mattress M supported on a box spring S. The cane holder 10 consists of a holder frame 12 and a cane clamp assembly 20 for holding a walking cane 14.

In the presently preferred form of the invention the holder frame 12 is a generally rectangular frame made of rigid metal tubing of rectangular cross section including four frame sides 18 joined at four comers of the frame and a frame cross member 22 spanning the midpoints of two opposite frame sides 18. A cane clamp 20 is secured to the frame 12, preferably at one comer of the frame. As shown in FIG. 2 the cane clamp assembly 20 includes two clamp elements, a fixed clamp element 24 fixed as by welding to the frame 12 and a movable clamp element 26 hinged to the frame on pivot 28, seen in FIGS. 4 and 5, for movement between an open condition illustrated in FIGS. 2 and 3 and a closed condition depicted in FIGS. 4 and 5. The two clamp elements are generally shaped as half-cylinders having an inside radius of curvature selected to closely encompass the outside radius of the shaft of a cane 14.

The walking cane 14 has a vertical cane shaft 30, a top handgrip 32 and a cane foot 34. It is presently preferred but not essential that the cane be a so-called quad style cane where the cane foot 34 is has four tips 36 arranged for contacting the ground in a rectangular patterns for greater stability. Quad style canes are in common use and are appropriate for users who require a greater degree of support than is offered by a basic single tip cane. Quad style canes are self-supporting on a level ground surface and for that reason are especially desirable in the present invention.

Figure 4:
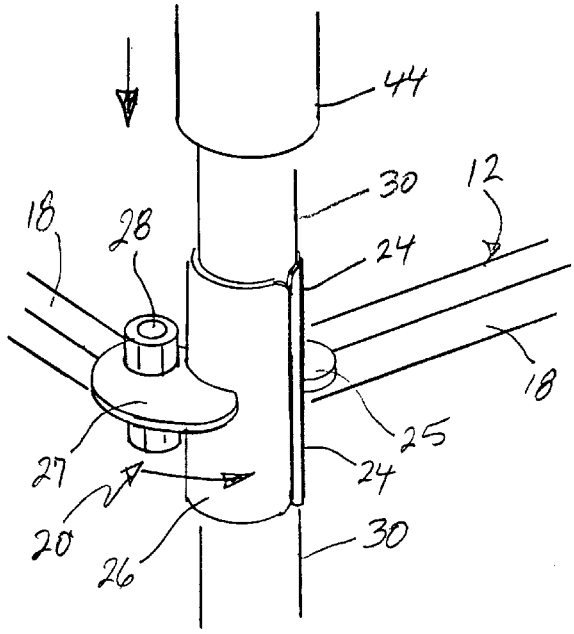
FIG. 4 shows the clamp elements closed about the walking cane.
Figure 5:
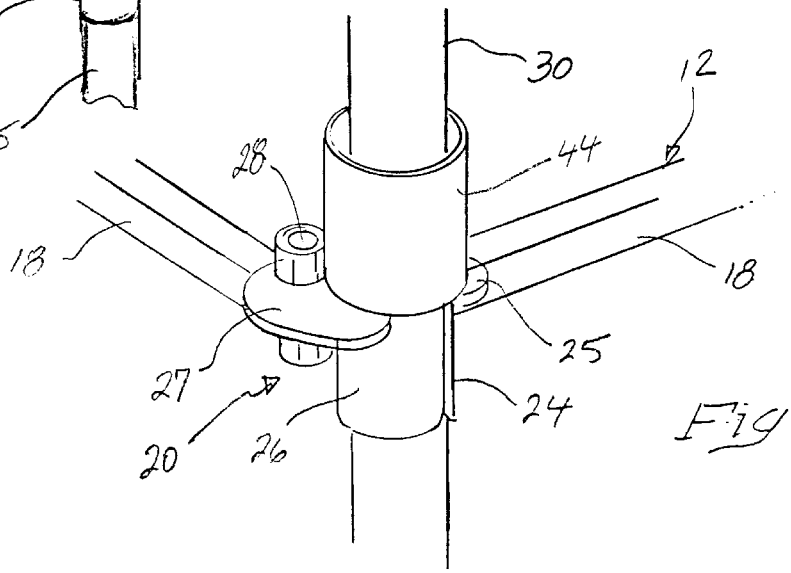
FIG. 5 illustrates the locking sleeve in locking position over the closed clamp elements to secure the cane to the holder.

The cane 14 is installed in the holder as shown in the sequence of FIGS. 3, 4 and 5. The cane shaft 30 is placed between the open clamp elements 24, 26 as in FIG. 3 after which the movable clamp element 26 is pivoted to its closed position as suggested by the arrow in FIG. 4. The dosed clamp elements 24, 26 together generally define a cylinder which closely encompasses the cane shaft. The cane shaft 30 may be free to slide longitudinally between the clamp elements so that the cane foot 34 comes to rest on the underlying floor surface.

A cylindrical locking sleeve 44 is freely slidable along the cane shaft 30 and has an inside diameter slightly oversized with respect to the outside diameter of the clamp elements 24, 26. The cane 14 is secured in the clamp assembly 20 by dropping the locking sleeve 44 over the closed clamp elements 24, 26 as shown in the sequence of FIGS. 4 and 5. The clamp elements are welded onto arms 25, 27 respectively, which also serve to stop and support the locking sleeve in the locking position depicted in FIG. 5, with the closed clamp elements captive inside the sleeve 44. Arm 25 is fixed to the frame 12 while arm 27 is pivoted to the frame by pivot 28.

The cane foot 34 is typically attached to the bottom end of a tube 15 which telescopes into the cane shaft 30 so as to permit adjustment of the cane height. The two tubes 15, 30 are fixed in a selected position by means of a cross pin inserted in aligned holes in the two tubes. The protruding head 17 of the cross-pin may also serve as a stop for the locking sleeve away from the clamp 20, to prevent the sleeve 44 from dropping to the cane foot and to keep the sleeve at a convenient height on the cane shaft 30.

The holder frame is inserted in a horizontal plane defined between the mattress M and the bed spring S of the bed B. The size of the frame 12 is sufficiently large so as to ensure that a significant portion of the user's body weight will bear down over the frame 12 so as to clamp the frame between the mattress and the bed spring while the user is reclining on the bed and also while the user is sitting on the side of the bed. For example the frame may be about 20 inches in width along the side of the bed and about 24 inches in length transversely to the side of the bed. The users weight thus serves to essentially anchor the frame 12 in place against lateral displacement in the horizontal plane and consequently holds the cane shaft 30 against lateral movement while the cane is held in the clamp assembly 20. The open interior of the frame is advantageous in this regard because it allows the mattress bottom to press directly against the top surface of the box-spring both inside the frame and outside the frame to more effectively capture the frame and hold it against lateral displacement under the mattress. It should be understood however, that the holder frame 12 can take many different forms and shapes, and need not be an open frame but may include sheet elements among other possibilities. In its essential function the frame is planar in shape so that it can be inserted in the bed without great impact on the comfort of the mattress M as perceived by the user, and sized and shaped so as to provide an adequate lateral support to keep the walking cane from falling sideways as long as the user's weight bears down on the frame through the mattress.

The cane 14 is preferably provided with a mid-height grip 40 which includes a handle 38 pivoted at 42 to the cane shaft 30 at a point intermediate the top handgrip 32 and the foot 34. As shown in FIG. 1 the mid-height grip 40 is located generally along the upper half of the cane shaft 30, that is, above a midpoint of the cane shaft, where it can be conveniently grasped by a user. The mid-height grip 40 does not make contact with the ground in an upright condition of the cane 14. The handle 38 is pivotable between a deployed position transverse or perpendicular to the cane shaft as shown in FIG. 1 and a retracted position generally parallel to the cane shaft as seen in FIG. 3.

A bracket 45 serves as a stop to transfer weight on the handle 38 to the cane shaft and support the handle 38 in the deployed position.

It will be appreciated from the drawings that the mid-height grip 40 is folded upwardly against the cane shaft from the transverse deployed position of FIG. 1 to the retracted position of FIG. 3. and when deployed the grip 40 swings downwardly onto the support bracket 45 which supports the grip. It is also seen in FIG. 1 that the two grips extend generally radially to the cane shaft along spaced apart radial directions, so that the two grips are also generally transverse to each other. When the cane is used for walking the mid-grip 40 is not usually needed and is retracted. When the cane is installed in the cane holder 10 as a bedside support the mid-grip 40 is deployed and by virtue of its lower position on the cane is easier to reach by a person reclining on the bed than the top handgrip 32. The mid-grip 40 can be used as a first hand pull in the initial stages of rising from the bed, for example to help the user swing his or her legs down from the bed, whereupon the top handgrip may come into easier reach. At this point, both the top handgrip 32 and the mid-grip 40 may be gripped, one with each hand by the user, and used for support as needed until he or she comes to a standing position, whereupon the mid-grip may be released and the top grip alone used for walking support.

Once the user has achieved a standing position at the side of the bed B. the locking sleeve 44 may be lifted away from the clamp elements 24, 26 to allow clamp element 26 to swing away from the cane shaft 30. The cane 14 is then free from the clamp assembly 20 and available for use as a walking aid away from the holder 10. It will be appreciated form the foregoing that the locking sleeve 44 is displaceable for securing the walking cane to the cane clamp 20 against accidental disengagement of the cane from the clamp while the person is rising from the bed. It is further seen that the cane clamp 20 remains with the frame 12 when the walking cane is released from the clamp for use as a walking aid away from the bed. The mid-grip 40 is not essential to the usefulness of this invention and the holder frame 12 may be used with walking canes of other designs. A suitable locking sleeve 44 or a functionally equivalent element can be retrofitted onto other walking canes for use with the holder 10.

From the foregoing it will be appreciated that the cane holder is easy to install in existing box spring/mattress beds and is of simple and convenient operation in order to help the infirm achieve a greater measure of self-reliance and independence at relatively low cost.

Although a preferred form of the invention has been described and illustrated for purposes of clarity and example, various changes, modifications and substitutions will be apparent to those having ordinary skill in the art without thereby departing from the scope of the invention as defined in the following claims.

What is claimed as new is:

1. A walking cane and cane holder for holding upright the walking cane at the side of a bed, comprising: a generally planar frame sized and configured to be inserted between a mattress and a box spring of the bed and to resist displacement from a generally horizontal plane defined between the mattress and the box spring, a clamp assembly secured to said frame so as to protrude to one side of the said mattress and box spring, said clamp assembly having first and second clamp elements hinged for movement between an open position for admitting said cane between said clamp elements and a closed position for holding said cane in transverse relationship to said frame, and a locking element on said cane, said locking element being displaceable for securing said clamp elements in said closed position with said cane held therebetween, such that the weight of a person bearing on the mattress over the frame operates to secure the cane for grasping as a support by the person while rising from the bed, and the cane can then be released from said clamp assembly by displacing said locking element for use as a walking aid away from the bed, said locking element remaining on said cane away from said clamp assembly.

2. The walking cane and cane holder of claim 1 wherein said first and second clamp elements are each a half-cylinder and said locking element is a sleeve slideable along said cane to and from a locking position, said clamp elements being contained in said sleeve and about said cane in said locking position, said cane having a cane shaft, a cane foot, and a stop for supporting said sleeve at a convenient height on the cane shaft above the cane foot while away from said clamp assembly.

3. The walking cane and cane holder of claim 1 wherein said frame is a generally rectangular frame having side measurements much greater than a longitudinal dimension of said clamp elements.

4. The walking cane and cane holder of claim 1 wherein said cane is a quad style cane.

5. The walking cane and cane holder of claim 1 wherein said cane has a top hand grip and a mid-height hand grip, said mid-height grip being pivoted to a shaft of the cane for movement between an extended position transverse to said shaft and a retracted position parallel to said shaft, such that said mid-height grip in said extended position supplements said top hand grip as the support for the person rising from the said bed while the cane is held in said clamp assembly.

6. The walking cane and cane holder of claim 1 wherein said holder frame is rectangular and said clamp assembly is mounted on a corner of said holder frame.

7. In combination, a walking cane and a cane holder for supporting the walking cane at the side of a bed, comprising:

a first member shaped and sized for insertion between a mattress and a box spring of the bed and a clamp assembly on said first member configured for releasably holding the cane in predetermined upright position relative to said first member, said cane being substantially free to slide longitudinally through said clamp assembly so that the cane may come to rest on an underlying floor surface, said cane having a locking element movable thereon to and from locking engagement with said clamp assembly for securing said cane in said clamp assembly, said locking element being carried on said cane away from said clamp assembly.

8. A walking cane and cane holder for holding upright the walking cane at the side of a bed, comprising:

a generally planar frame sized and configured to be inserted between a mattress and a box spring of the bed and to resist displacement from a generally horizontal plane defined between the mattress and the box spring, a clamp assembly secured to said frame so as to protrude to one side of the said mattress and box spring, said clamp assembly having a first clamp element fixed to said frame and a second clamp element pivoted to said frame for movement between an open position for admitting said cane between the clamp elements and a closed position for holding said cane between the clamp elements in transverse relationship to said frame;

a sleeve freely slidable on said cane into a locking position for securing said clamp elements in said closed position with said cane held therebetween, said sleeve being upwardly slidable on said cane for releasing said clamp elements from said closed position thereby to make available said cane for use as a walking aid away from said clamp assembly, said sleeve remaining on said cane away from said clamp assembly, and a stop on said cane for supporting said sleeve at a convenient height above a foot of said cane.

9. A walking cane and cane holder for holding upright the walking cane at the side of a bed, comprising:

a frame sized and configured to be inserted between a mattress and a box spring of a bed and to resist displacement from a generally horizontal plane defined between the mattress and the box spring, and a clamp secured to said frame so as to protrude to one side of the said mattress and box spring, said clamp operable for holding said cane in transverse relationship to said frame, such that the cane is available as a support to aid a debilitated person in rising from said bed to a standing position next to the bed, and said cane may be released from said clamp and the cane holder for use as a walking aid away from the said bed by the same person, said clamp remaining with said frame after said release.

10. The cane holder of claim 9 wherein said cane is substantially free to slide longitudinally through said clamp so that the cane may come to rest on an underlying floor surface.

11. The cane holder of claim 9 wherein said clamp has first and second clamp elements hinged for movement between an open position for admitting said cane between said clamp elements and a closed position for holding said cane in said transverse relationship, and further comprising a locking element displaceable for securing said clamp elements in said closed position.

12. A walking cane and cane holder for holding upright the walking cane at the side of a bed, comprising:

a frame sized and configured to be inserted between a mattress and a box spring of a bed and to resist displacement from a generally horizontal plane defined between the mattress and the box spring, and a clamp operable for holding said cane to one side of the said mattress and box spring in transverse relationship to said frame, such that the cane is available as a support to aid a debilitated person in rising from the bed to a standing position next to the bed and said cane may be released from said clamp and the cane holder for use as a walking aid away from the said bed by the same person, and a locking element displaceable for securing the cane to said clamp thereby to prevent accidental disengagement of the cane from the clamp while the person is rising from the bed.

* * * * *